United States Patent [19]

Kashimoto et al.

[11] Patent Number: 4,547,638

[45] Date of Patent: Oct. 15, 1985

[54] VACUUM INTERRUPTER

[75] Inventors: Yutaka Kashimoto, Numazu; Masayuki Kano, Shizuoka; Toshimasa Fukai, Numazu, all of Japan

[73] Assignee: Kabushiki Kaisha Meidensha, Japan

[21] Appl. No.: 493,922

[22] Filed: May 12, 1983

[30] Foreign Application Priority Data

May 20, 1982 [JP] Japan ..... 57-73655[U]

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,086,459 4/1978 Rich ..... 200/144 B 4,408,107 10/1983 Sakuma et al. ..... 200/144 B

FOREIGN PATENT DOCUMENTS 0043258 1/1982 European Pat. Off. ..... 200/144 B

*Primary Examiner*—Robert S. Macon

*Attorney, Agent, or Firm*—Lowe, King, Price & Becker

[57] ABSTRACT

A vacuum interrupter includes a vacuum envelope having a cylindrical metallic housing with at least one opening end and a disc-shaped and apertured end plate of insulating ceramics which is hermetically sealed to the opening end. One metallized layer to which the opening end is hermetically brazed is in an outer-diameter region of a sealing surface of the plate, while another metallized layer to which another metallic members of the envelope is hermetically brazed is formed in an inner-diameter region of the plate. There are provided, within the envelope near two spaced edges of the inner-diameter region and outer-diameter region metallized layers, metallized-layer-edge shields having opposite surfaces separated by a distance which is smaller than that between the metallized layers. Each of the opposite surfaces has extensions at the axial opposite ends so that each extension extends away from an extension of the other surface. The shields increase significantly the internal dielectric strength of the envelope.

10 Claims, 7 Drawing Figures

VACUUM INTERRUPTER

BACKGROUND OF THE INVENTION

The present invention relates to a vacuum interrupter, particularly to a vacuum interrupter including a vacuum envelope a major portion of which consists of a generally cylindrical (including bottom-cylindrical) metallic housing and a disc-shaped insulating end plate, made of insulating ceramics, hermetically brazed to an opening end of the metallic housing.

For the purpose of size-down and production cost-down, a vacuum envelope of a vacuum interrupter which, as described above, includes in the main a metallic housing and insulating end plate has replaced one which includes in the main an insulating cylinder made of insulating ceramics or crystallized glass and a metallic end plate hermetically sealed to the opposite opening ends of the insulating cylinder (See U.S. patent application No. 276,862).

Since the insulating surface distance of an insulating end plate is shorter than that of an insulating cylinder if vacuum interrupters of the two types described above are equal in interruption capacity, dielectric strength per unit length of the insulating end plate must be greater than that of the insulating cylinder. Therefore, voltage distribution per unit length for the insulating end plate, i.e., electric field intensity therein, is necessarily greater than that in the insulating cylinder.

Moreover, in case of a vacuum envelope as described above including in the main a metallic housing and an insulating end plate, both the members are conventionally united with each other by hermetic-brazing the surface of an opening edge of the metallic housing in the surface-to-surface manner to an extremely thin metallized layer which covers the outer peripheral region of the sealing surface of the insulating end plate. In view of the shape, the metallized layer, the inner edge region of the surface and the extremely narrow side surface thereof caused to appear within the vacuum envelope, has a capability of electric field concentration.

Moreover, where the insulating end plate centrally has an aperture through which an electrode lead rod extends, and where metallized layers cover the inner peripheral region as well as the outer peripheral region in the sealing surface of the insulating end plate, the electric field concentration which is effected at the respective extremely thin edge surfaces of both the metallized layers, opposed to each other, is ready to trigger insulation breakdown between the metallized layers.

Moreover, since the metallized layer microscopically has small protrusions thinly spread over the surface, which causes electric field concentration, the layer is capable of triggering the internal insulation breakdown of the vacuum envelope.

Moreover, the metallized layer is made of Mn, W, Mo or the like which has a pronounced tendency to effect electron emission. This feature also leads to the internal insulation breakdown of the vacuum envelope.

SUMMARY OF THE INVENTION

The object of the present invention is to provide a vacuum interrupter having a vacuum envelope of which is much improved in the internal dielectric strength. According to the inventive vacuum interrupter, two spaced edges, appearing within the envelope, of extremely thin metallized layers which are formed in a hermetic-sealing surface of insulating end plate and to which a cylindrical metallic housing and other members of the envelope are brazed are shielded from electric field concentration by an electrically conductive shield for a metallized layer edge.

Dielectric strength of a vacuum envelope having the metallized-layer edge shield is about between 1.5 and 2 times that of another vacuum envelope having no metallized-layer-edge shield.

Other objects and advantages of the present invention will be apparent from the following description, claims and attached drawings.

DESCRIPTION OF THE PREFERRED EMBODIMENTS

Figure 1:
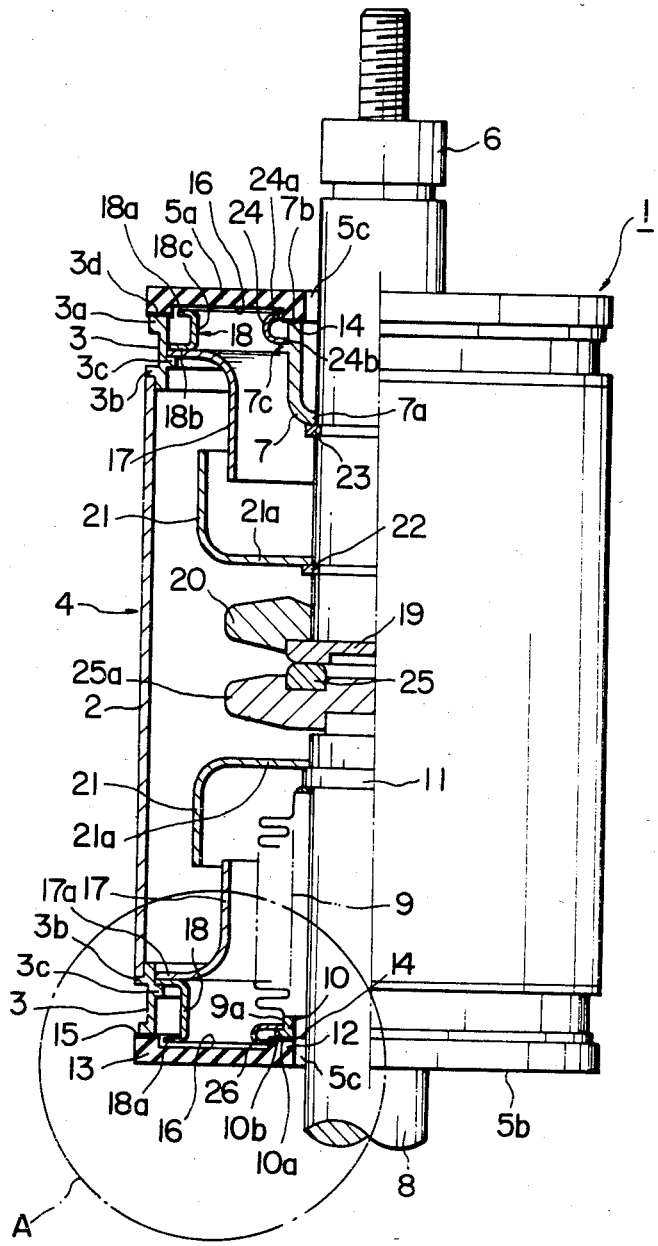
FIG. 1 shows a longitudinally fragmented sectioned view of a vacuum interrupter in accordance with a first embodiment of the present invention.

The vacuum interrupter, shown in FIG. 1, in accordance with the first embodiment of the present invention, includes a vacuum envelope 1 comprising the following listed members. The members consist of: a generally cylindrical metallic housing 4 consisting of a metallic cylinder 2 and the first sealing members 3 which are in the form of a substantially short metallic cylinder and hermetically brazed in the compression seal manner to the opposite ends of the metallic cylinder 2; disc-shaped insulating end plates 5*a* and 5*b* hermetically brazed in the surface-to-surface manner to outer edge surfaces 3*d* of the first sealing members 3; a stationary electrode lead rod 6; the second sealing member 7 which is in the form of a substantially metallic cylinder and serves to hermetically unite the stationary lead rod 6 and the insulating end plate 5*a*; a movable electrode lead rod 8 in alignment with and near or away from the stationary lead rod 6; a bellows 9 located around the movable lead rod 8 within the metallic housing 4; the third sealing member 10 which is in the form of a substantially short metallic cylinder and serves to hermetically unite the outer end of the bellows 9 and the insulating end plate 5*b* and; an enlarged-diameter portion 11 integrally of the movable lead rod 8 which serves as an aid for hermetic-brazing the inner end of the bellows 9 to the movable lead rod 8.

The metallic cylinder 2 is for instance made of austenitic stainless steel.

The first sealing member 3 as mentioned above is made of Fe-Co-Ni or Fe-Ni alloy or copper for instance. Particularly, the first sealing member 3 made of copper serves to neutralize in plastic deformation thereof thermal stress which is to be generated in the metallic cylinder 2, the insulating end plates 5*a* and 5*b* and brazed portions between the metallic cylinder 2 and insulating end plates 5*a* and 5*b* in a slow-cooling process after a hermetic brazing.

Each first sealing member 3 is provided at a part of the outer periphery of the outer end with a first outward flange 3*a* which is hermetically brazed in the surface-to-surface manner to the insulating end plates 5*a* and 5*b*. It is also provided near a part of the outer periphery of the inner end with the second outward flange 3*b* which is hermetically brazed to the edge surface of the opening end of the metallic cylinder 2. It is still further provided near a part of the inner periphery of the inner end and the opposite second outward flange 3*b* with an inward flange 3*c*.

The insulating end plates 5*a* and 5*b* are made of insulating ceramics as alumina ceramics, steatite ceramics, mullite ceramics, zircon ceramics or the like. The insulating end plates 5*a* and 5*b* have at the center thereof respective apertures 5*c* through which the stationary and movable lead rods 6 and 8 extend into the metallic housing 4. The respective sealing surfaces of the insulating end plates 5*a* and 5*b* are provided with annular inner-diameter side and outer-diameter side shoulders 12 and 13.

Inner-diameter side and outer-diameter side metallized layers 14 and 15, being extremely thin, are overall formed by conventional methods in the surfaces of the respective inner-diameter side and outer-diameter side shoulders 12 and 13, which are separated from each other by an annular groove 16 therebetween. The groove 16 is about between 0.1 and 3 mm in depth so as to increase surface dielectric strength in the vacuum envelope 1 of each insulating end plate 5*a* or 5*b*.

The outer edge surface 3*d* of each first sealing member 3 is hermetically brazed to the outer-diameter side metallized layer 15. Since the outer edge surface 3*d* of the first sealing member 3 is narrower in width than the outer-diameter side metallized layer 15 and, as apparent from FIG. 2, the first outward flange 3*a* of the first sealing member 3, in view of a difference between coefficients of thermal expansion of the first sealing member 3 and insulating end plate 5*a* or 5*b*, is located so as to overlap neither the inner nor outer edge of the outer-diameter side metallized layer 15, the inner edge region of each outer-diameter side metallized layer 15 is caused to appear within the vacuum envelope 1.

An auxiliary arc shield 17 and a first annular metallized-layer-edge-shield 18, which will later be described in detail, are brazed to the inward flange 3*c* of each first sealing member 3.

The stationary lead rod 6 extends into the metallic housing 4 through the aperture 5*c* of the insulating end plate 5*a*. Located within the vacuum envelope 1 is the inner end of the stationary lead rod 6 to which a disc-shaped stationary electrode 20 including a stationary contact 19 is secured by brazing. A main arc shield 21 which is in the form of a cylinder with an apertured bottom is secured to the stationary lead rod 6 behind the stationary electrode 20 by brazing via a snap ring 22 at a bottom 21*a* of the shield 21 to the rounded periphery of the rod 6. The main arc shield 21 will be described in detail later.

The second sealing member 7, which is made of the same material as the first sealing member 3, is of a cup shape and provided at the inner end with an apertured bottom 7*a* which is hermetically brazed to the rounded periphery of the stationary lead rod 6 via a snap ring 23.

The outer edge surface 7*b* of the second sealing member 7 is hermetically brazed to the inner-diameter side metallized layer 14 of the insulating end plate 5*a*. The relationship between the outer edge surface 7*b* and the inner-diameter side metallized layer 14 is the same as between the outer edge surface 3*d* of the first sealing member 3 and the outer-diameter side metallized layer 15. Therefore, the outer edge region of the inner diameter side metallized layer 14 is caused to appear within the vacuum envelope 1.

The second sealing member 7 is provided near a part of the outer periphery of the outer edge with an outward flange 7*c*.

The second annular metallized-layer-edge-shield 24 which will be in detail described later is brazed to the outward flange 7*c*.

The movable lead rod 8, as the stationary lead rod 6, extends into the metallic housing 4 through the aperture 5*c* of the insulating end plate 5*b*. A disc-shaped movable electrode 25*a* including a movable contact 25 is brazed to the inner end of the rod 8.

The bottom 21*a* of another main arc shield 21 is secured by brazing to the enlarged diameter portion 11 and periphery of the movable lead rod 8.

The bellows 9, which is made of austenitic stainless steel for instance, is provided at the outer end with a brazing cylinder 9*a*. The outer periphery and the outer edge surface 10*a* of the third sealing member 10 are hermetically brazed in the compression seal or surface-to-surface manner to the respective brazing cylinder 9*a* of the bellows 9 and to the inner-diameter side metallized layer 14 of the insulating end plate 5*b*. The relationship between the outer edge surface 10*a* and inner-diameter side metallized layer 14 is also the same as between the outer edge surface 3*d* of the first sealing member 3 and the outer-diameter side metallized layer 15. Therefore, the outer edge region of the inner-diameter side metallized layer 14 of the insulating end plate 5*b* is caused to appear within the vacuum envelope 1.

The third sealing member 10 which is made of the same material as the first sealing member 3 is provided near a part of the outer periphery of the outer edge with an outward flange 10*b*. A third annular metallized-layer-edge-shield 26, which will be described in detail later, is brazed to the outward flange 10*b*.

The bellows 9, the thickness of which is about 0.1 mm, may be brazed directly to the metallized layer in the inner-diameter side surface defining the aperture 5*c* (see FIG. 5) regardless of a difference between coefficients of thermal expansion of the bellows 9 and insulating end plate 5*b*.

Both of the main and auxiliary arc shields 21 and 17, which are made of iron or austenitic stainless steel for instance, are provided to prevent metallic vapor, generated between the stationary and movable electrodes 20 and 25*a* in closing or opening of the stationary and movable contacts 19 and 25, from depositing on portions, appearing within the vacuum envelope 1, of the inner surfaces of the insulating end plates 5*a* and 5*b* (hereinafter referred to as vacuum-chamber-side surfaces). Particularly, the main arc shield 21 has a shape adapted so as to prevent the metallic vapor from directly depositing on the vacuum-chamber-side surface of the insulating end plate 5*a* or 5*b*, while, particularly, the auxiliary arc shield 17 has a position and shape adapted so as to prevent the metallic vapor which is reflected on the inner surface of the metallic cylinder 2, from depositing on the vacuum-chamber-side surface of the insulating end plate 5*a* or 5*b*.

The inner-diameter of the cylindrical portion of the main arc shield 21 is somewhat greater than the outer-diameter of the cylindrical portion of the auxiliary arc shield 17. Moreover, the edges of the cylindrical portions of the main and auxiliary arc shields 21 and 17 always overlap each other. Bending portions between the cylindrical portion and bottom 21*a* of the main arc shield 21 and between the cylinderical portion and outward flange 17*a* of the auxiliary arc shield 17 are both rounded to prevent electric field concentration.

Each of the first metallized-layer-edge shields 18 which is in the form of a generally short cylinder is provided at the opposite ends of a cylindrical portion 18*c* with an electric field concentration preventing outward flange 18*a* and a fixing outward flange 18*b*. The roundness which is borne on the extension from the inner surface of the cylindrical portion 18*c* to the one surface 18*d* of the electric field concentration preventing outward flange 18*a* facilitates to prevent the occurrence of electric field concentration. It need not be borne if the voltage grade of the vacuum interrupter is low.

Figure 2:
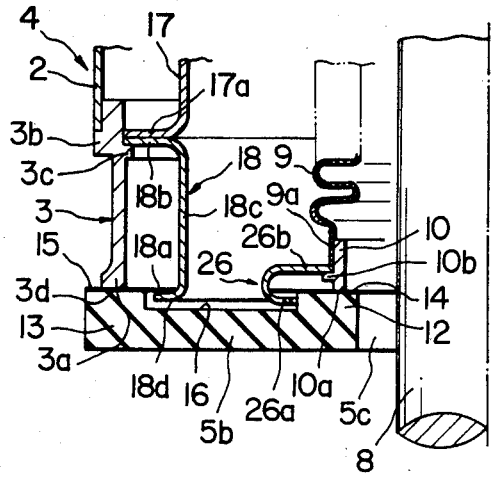
FIG. 2 is an enlarged view of the encircled portion A of FIG. 1.

As shown in FIGS. 1 and 2, each first metallized-layer-edge shield 18 is located by the first sealing member 3 so that the one surface 18*d* of the electric field concentration preventing outward flange 18*a* approaches the bottom of the groove 16 beyond a level of the surface of the outer-diameter side metallized layer 15. Thus, the inner edge region of the outer-diameter side metallized layer 15 will be much lessened in electric field concentration.

Both the first metallized-layer-edge shields 18 are made of electrically conductive material as austenitic stainless steel or copper, which causes little electron emission and is relatively great in mechanical strength and still brazable.

The second or third metallized-layer-edge shield 24 or 26 which is a ring having a J-shaped cross section is provided with an electric field concentration preventing inward flange 24*a* or 26*a* and a fixing inward flange 24*b* or 26*b*. The electric field concentration preventing inward flange 24*a* or 26*a*, as the electric field concentration preventing inward flange 18*a* of the first metallized-layer-edge shield 18, is located by the second or third sealing member 7 or 10 so that the outer surface of the inward flange 24*a* or 26*a* approaches the bottom of the groove 16 beyond a level of the surface of the inner-diameter side metallized layer 14. Thus, the outer edge region of the inner-diameter side metallized layer 14 will be subjected to a much lessened electric field concentration. The second or third metallized-layer-edge shield 24 or 26 is made of the same material as the first metallized-layer-edge shield 18.

According to the above embodiment, the dielectric strength of the vacuum envelope 1 is about between 1.5 and 2 times that of a vacuum envelope lacking in a metallized-layer-edge shield.

Were either the first metallized-layer-edge shield 18 or the second or third metallized-layer-edge shield 24 or 26 opposing thereto is provided, the one will prevent the occurrence of electric field concentration at either metallized layer 14 or 15. Thus, the dielectric strength between the metallized layer 14 and 15 is greater than that between metallized layers of a vacuum interrupter lacking in a metallized-layer-edge shield.

Figure 3:
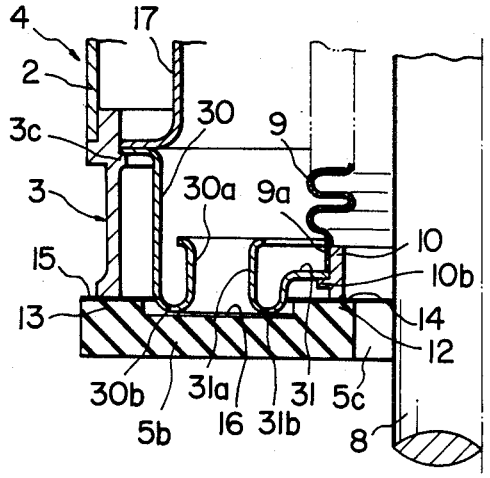
FIG. 3 is an enlarged view as FIG. 2, of a vacuum interrupter in accordance with a second embodiment of the present invention.

According to the second embodiment of the present invention, the first metallized-layer-edge shields 30, as shown in FIG. 3, are formed for electric field concentration preventing inside flange 30*a* thereof to curl inward. In this case, each first metallized-layer-edge shield 30 is located by the first sealing member 3 so that the center of a bending portion 30*b* which is formed between the outer periphery of the cylindrical portion of the first metallized-layer-edge shield 30 and the inner surface of the electric field concentration preventing inside flange 30*a*, approaches the bottom of the groove 16 beyond the level of the surface of the outer-diameter side metallized layer 15.

While the third metallized-layer-edge shield 31 is formed for an electric field concentration preventing outside flange 31*a* to curl inward. In this case too, a bending portion 31*b* between the inner periphery of the cylindrical portion of the third metallized edge shield 31 and the outer surface of an electric field concentration preventing outside flange 31*a* is formed similarly to the bending portion 30*b* of the first metallized-layer-edge shield 30.

The second metallized-layer-edge shield is not shown. A shape thereof and relationship to the inner-diameter side metallized layer 14, however, are substantially the same as those of the third metalllized-layer-edge shield 31. Advantages of the second embodiment are substantially the same as those of the first embodiment.

Figure 4:
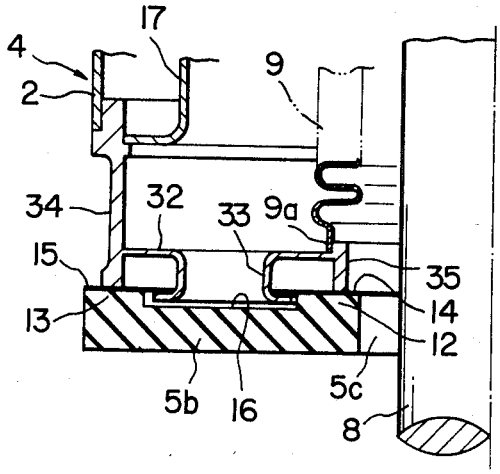
FIG. 4 is an enlarged view as FIG. 2, in a vacuum interrupter in accordance with a third embodiment of the present invention.

According to the third embodiment, the first and third metallized-layer-edge shields 32 and 33, as shown in FIG. 4, are integrally formed to the respective first and third sealing member 34 and 35. Consequently, both the first and third metallized-layer-edge shields 32 and 33 are necessarily made of metal as copper if the first and third sealing members 34 and 35 made of copper. The second metallized-layer-edge shield is not shown. However, it is substantially as same as the third metallized-layer-edge shield 33. Advantages of the third embodiment are substantially as same as those of the first embodiment.

Figure 5:
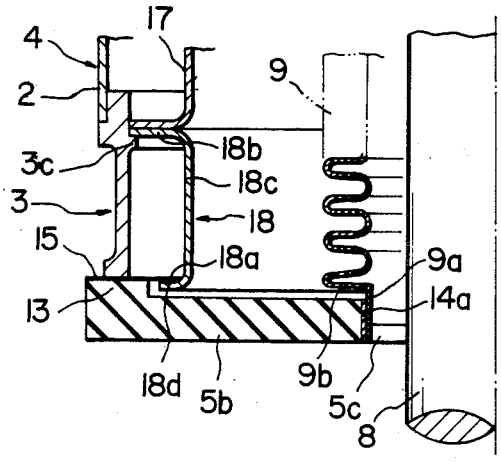
FIG. 5 is an enlarged view as FIG. 2, in a vacuum interrupter in accordance with a fourth embodiment of the present invention.

According to the fourth embodiment, the bellows 9, as shown in FIG. 5, is directly brazed in the surface-to-surface seal manner to the inner edge surface defining the aperture 5*c* of the insulating end plate 5*b* via a metallized layer 14*a* so that the element 9*b* at the outer end of the bellows 9 replaces the third metallized-layer-edge shield according the previously described embodiments. Advantages of the fourth embodiment are substantially as same as those of the first embodiment.

Figure 6:
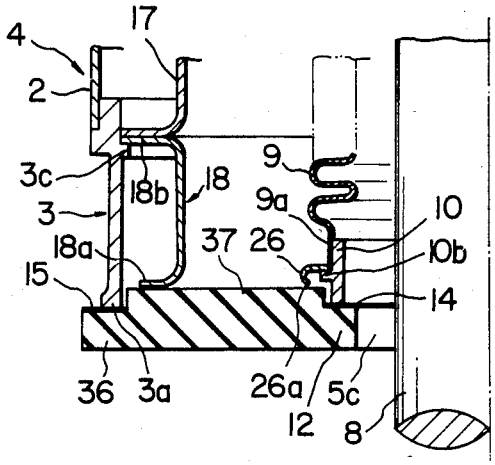
FIG. 6 is an enlarged view as FIG. 2, in a vacuum interrupter in accordance with a fifth embodiment of the present invention.

According to the fifth embodiment, the inner-diameter side and outer-diameter side metallized layers 14 and 15 of each insulating end plate 36, as shown in FIG. 6, are separated from each other by an annular barrier 37 protruded therebetween. The first or third metallized-layer-edge shield 18 or 26 is located by the first or third sealing members 3 or 10 so that the electric field concentration preventing outward or inward flange 18*a* or 26*a* closely approaches the surface of the annular barrier 37, curling outwardly or inwardly. The second metallized-layer-edge shield is not shown. The shape and function thereof are substantially as same as those of the third metallized-layer-edge shield 26. The outer and inner edge regions of the respective inner-diameter side and outer-diameter side metallized layers 14 and 15 are shielded from electric field concentration.

Figure 7:
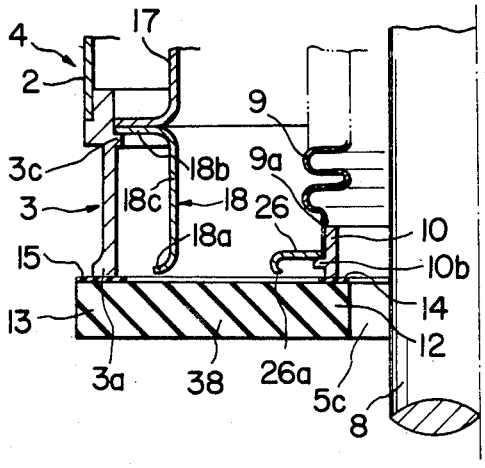
FIG. 7 is an enlarged view as FIG. 2, in a vacuum interrupter in accordance with a sixth embodiment of the present invention.

According to the sixth embodiment, the inner surface of each insulating end plate 38, as shown in FIG. 7, is flat and the respective outer and inner edge regions of the respective inner-diameter side and outer-diameter side metallized layers 14 and 15 are shielded from electric field concentration by the first and third metallized-layer-edge shields 18 and 26.

The above descriptions all direct to a vacuum envelope comprising a cylindrical metallic housing including opposite opening ends and consisting of a metallic cylinder with the opposite ends and with opening sealing members. However, they are also applicable to a vacuum envelope including only a metallic cylinder with the opposite ends opening, to a vacuum envelope comprising a cylindrical metallic housing including the one opening end and consisting of one-bottomed metallic cylinder and sealing member located at the opening end of the cylinder and to a vacuum envelope comprising a metallic bottomed cylinder as a metallic housing.

What is claimed is:

1. A vacuum interrupter having a vacuum envelope, comprising:

at least one disc-shaped insulating end plate of insulating ceramics which has a closable aperture of a center thereof;

inner-diameter side and outer-diameter side metallized layers which are respectively formed in an inner-diameter region of a sealing surface of said plate and an outer-diameter region of said plate, said inner and outer metallized layers each having an edge within said vacuum envelope, said edges separated from one another;

a cylindrical metallic housing having at least one opening end which is hermetically brazed to said outer-diameter side metallized layer; and a metallized-layer-edge shield means provided within said vacuum envelope near at least one of the spaced edges of the inner-diameter side and outer-diameter side metallized layers, for preventing occurrence of electric field concentration at the edge of said metallized layers.

2. A vacuum interrupter as defined in claim 1, wherein each of said inner-diameter side and outer-diameter side metallized layers is formed in respective surfaces of shoulders protruding from the sealing surface of said plate.

3. A vacuum interrupter as defined in claim 1, wherein said outer-diameter side metallized layer is formed in a surface of an outer-diameter side shoulder protruding from the sealing surface of said plate.

4. A vacuum interrupter as defined in claim 1, wherein said metallized-layer-edge shield means is an integral part of said metallic housing.

5. A vacuum interrupter as defined in claim 1, wherein said metallized layer edge shield means is disposed in the space betweeen said inner and outer diameter side metallized layers.

6. A vacuum interrupter comprising:

(a) a hollow cylindrical metallic housing having at least one opening end;

(b) at least one disc-shaped end plate which is made of insulating ceramics and attached to the opening end of the housing and has a closable aperture at a central portion thereof;

(c) a stationary lead rod and a movable lead rod which respectively extend into said metallic housing with said movable lead rod passing through the aperture and which have inner ends respectively supporting separable electrical contacts;

(d) a bellows between said movable lead rod and said end plate, one end of said bellows connecting to said movable lead rod and another end of said bellows connecting to said end plate;

(e) an inner-diameter side metallized layer and an outer-diameter side metallized layer, respectively formed in an inner-diameter region of a sealing surface of said end plate and in an outer-diameter region of said end plate, said outer-diameter side metallized layer being hermetically brazed to the opening end of said metallic housing;

(f) an inner-diameter side metallized-layer-edge shielding means which is provided near an edge of said inner-diameter side metallized layer disposed within a vacuum envelope of said interrupter;

(g) an outer-diameter side metallized-layer-edge shielding means which is provided near an inner edge of said outer-diameter side metallized layer disposed within the vacuum envelope;

(h) said inner-diameter side and outer-diameter side metallized-layer-edge shielding means each having a respective surface, said surfaces arranged in opposition to one another and separated by a distance;

(i) two inwardly curved extensions provided at axially opposite ends of said surface of said inner-diameter side metallized-layer-edge shielding means, one of said inwardly curved extensions being close to the sealing surface;

(j) two outwardly curved extensions provided at axially opposite ends of said surface of said outer-diameter side metallized-layer-edge shielding means, one of said outwardly curved extensions being close to the sealing surface;

(k) wherein the distance between said opposite surfaces is smaller than a distance between said inner-diameter side and outer-diameter side metallized layers, said surface of said inner-diameter side shielding means and said inner-diameter side metallized layer being electrically equipotential, and said surface of said outer-diameter side shielding means and said outer-diameter side metallized layer being electrically equipotential; and (l) wherein the vacuum envelope is composed of said metallic housing, end plate, stationary lead rod, movable lead rod, bellows, and inner-diameter side and outer-diameter side metallized layers.

7. A vacuum interrupter as defined in claim 6, wherein each of said inner-diameter side and outer-diameter side metallized layers is formed on respective surfaces of shoulders protruding from the sealing surface of said plate.

8. A vacuum interrupter as defined in claim 6, wherein said outer-diameter side metallized layer is formed on a surface of an outer-diameter side shoulder protruding from the sealing surface of said plate.

9. A vacuum interrupter as defined in claim 6, wherein said metallized-layer-edge shield is an integral part of said metallic housing.

10. A vacuum interrupter comprising:

(a) a hollow cylindrical metallic housing having at least one opening end;

(b) at least one disc-shaped end plate which is made of insulating ceramics and attached to the opening end of the housing and has a closable aperture at a central portion thereof;

(c) a stationary lead rod and a movable lead rod which respectively extend into said metallic housing, at least one of said lead rods passing through the aperture, said lead rods having inner ends respectively supporting separable electrical contacts;

(d) sealing means provided between said at least one of lead rods and said end plate for sealingly connecting said lead rod to said end plate;

(e) an inner-diameter side metallized layer and an outer-diameter side metallized layer, respectively formed in an inner-diameter region of a sealing surface of said end plate and in an outer-diameter region of said end plate, said outer-diameter side metallized layer being hermetically brazed to the opening end of said metallic housing;

(f) an inner-diameter side metallized-layer-edge shielding means which is provided near an edge of said inner-diameter side metallized layer disposed within a vacuum envelope of said interrupter;

(g) an outer-diameter side metallized-layer-edge shielding means which is provided near an inner edge of said outer-diameter side metallized layer disposed within the vacuum envelope;

said inner-diameter side and outer-diameter side metallized-layer-edge shielding means arranged in opposition to one another and separated by a distance;

wherein the distance between said inner-diameter and outer-diameter shielding means is smaller than a distance between said inner-diameter side and outer-diameter side metallized layers.

* * * * *